United States Patent [19]

Molin

[11] 4,351,132

[45] Sep. 28, 1982

[54] MACHINE FOR CLEANING VERTICAL OR INCLINED SURFACES

[75] Inventor: Roland Molin, Gothenburg, Sweden

[73] Assignee: PR Processutveckling AB, Vastra Frolunda, Sweden

[21] Appl. No.: 190,567

[22] Filed: Sep. 25, 1980

[30] Foreign Application Priority Data

Sep. 28, 1979 [SE] Sweden ..... 7908048

[51] Int. Cl.[3] ..... B24B 23/00

[52] U.S. Cl. ..... 51/180

[58] Field of Search ..... 51/180, 174; 15/49 R, 15/49 C, 50 R, 50 C, 230.19, 52

[56] References Cited

U.S. PATENT DOCUMENTS

| | | | |
|---|---|---|---|
| 1,947,286 | 2/1934 | Bitterbaum | 51/180 |
| 2,118,276 | 5/1938 | Temple | 15/50 C |
| 2,660,009 | 11/1953 | Goldberg | 15/230.19 |

FOREIGN PATENT DOCUMENTS

| | | | |
|---|---|---|---|
| 644246 | 6/1928 | France | 51/180 |
| 1080353 | 8/1967 | United Kingdom | 51/180 |

*Primary Examiner*—Roscoe V. Parker

*Attorney, Agent, or Firm*—Holman & Stern

[57] ABSTRACT

A machine for cleaning walls such as the reactor cavity walls in a nuclear power plant by means of at least one rotatable roller brush. For cleaning machines that must be used hanging by wires it is difficult to achieve a sufficient bearing pressure against the wall to be cleaned. Especially in deep cavities the bearing pressure decreases the longer the cleaning machine reaches into the cavity. The problem has been solved by using a roller brush comprising a plurality of soft grinding sheaves which are axially compressible and decompressible for changing the density of the roller brush and by having counterweight means provided with means for increasing or decreasing its weight and thus changing the weight distribution of the machine for changing the bearing pressure of the machine against the wall.

8 Claims, 5 Drawing Figures

MACHINE FOR CLEANING VERTICAL OR INCLINED SURFACES

TECHNICAL FIELD

The present invention refers to a machine for cleaning vertical or inclined surfaces, especially reactor cavity walls, said machine comprising at least one rotatable roller brush supported by a frame, which is freely suspended from a lifting device by at least one wire and which is provided with a counterweight means at the side remote from the roller brush.

BACKGROUND OF THE INVENTION

The reactor cavity walls and the fuel cavity walls in a nuclear power plant have hitherto mainly been cleaned manually with cloths soaked in acetone. Besides being a very time consuming job, it is performed in an unhealthy environment owing both to the radioactivity and the acetone vapour. Attempts have been made to perform this decontamination work by means of rotating brushes and simultaneously sprinkling water over the surface to be cleaned and high pressure washing with the use of chemicals has also been tried, but the purity requirements have not been fulfilled with these methods. A reason for the difficulties is that with the conventional devices it is difficult to achieve the surface pressure against the cavity walls that is required, especially when high pressure washing and brushing are performed simultaneously. Owing to the varying shape of the cavities and the narrow spaces between the cavity wall and projecting structural elements etc., there can only be used a cleaning machine, which hangs from a crane, or a telpher. The cleaning machine must be so constructed that it is easily remote controlled by hand, it must be used in an empty as well as in a waterfilled cavity and it should be easy to decontaminate, e.g. by lowering it into a cleaning bath.

A problem connected with the requirement of having the cleaning machine hanging from wires is that the bearing pressure of the machine against the cavity wall is decreased the deeper the machine descends into the cavity. For cavities with a depth of 10–12 m this is a considerable problem.

SUMMARY OF THE INVENTION

The object of the invention is to eliminate the above mentioned drawbacks and to provide a cleaning machine which despite its light and simple construction provides the required bearing pressure against the cavity wall along the entire depth thereof. The bearing pressure against the wall should however not be too high, since in this case the brush would be deformed and dirt particles from the wall would adhere or be pressed into the brush causing a rapid reduction of the brushing effect.

The cleaning machine according to the invention comprises at least one roller brush supported by a frame, which is freely suspended by at least one wire from a lifting device and which at the side remote from the roller brush is provided with a counterweight means, the roller bursh comprising a plurality of soft grinding sheaves passed through or attached to a shaft, said grinding sheaves being axially compressible by means of a compressing means in order to change the density of the roller brush and the contact surface against the wall to be cleaned, said counterweight means being provided with means for increasing or decreasing its weight and changing the position of the centre of gravity of the machine and thus changing the bearing pressure against the wall.

DESCRIPTION OF PREFERRED EMBODIMENTS

Figure 1:
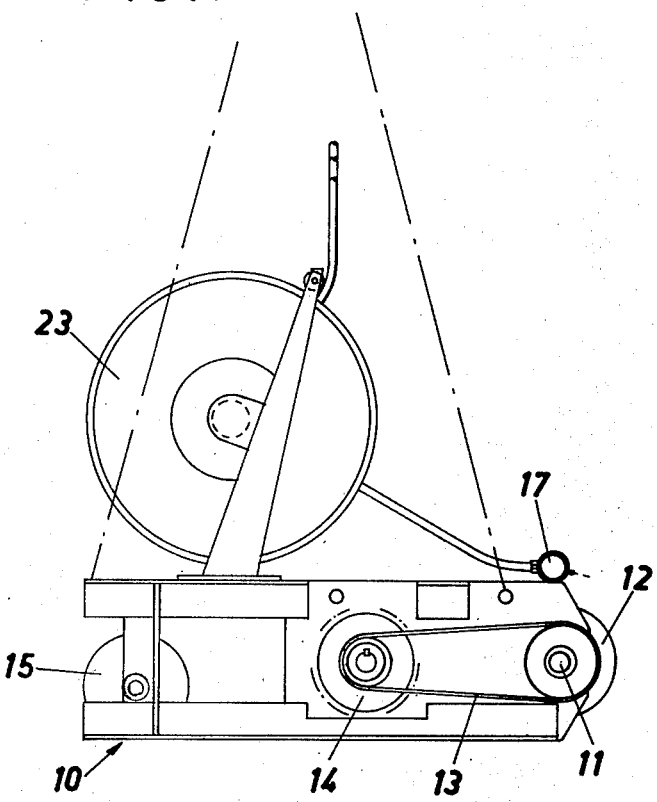
FIG. 1 is a side view of the cleaning machine.

The cleaning machine according to the invention comprises a rectangular frame 10, a shaft 11 mounted at one side of the frame and a plurality of soft grinding sheaves passed through or attached to said shaft, said grinding sheaves forming the roller brush 12 of the cleaning machine. The machine is driven by an air-driven motor 14 by way of a transmission means 13, said motor being arranged in the central portion of the frame 10. A counterweight means 15 is arranged at the side of the frame 10 remote from the roller brush 12. The counterweight means comprises either a plurality of easily removable counterweight discs or a container, which can be filled with e.g. water when the bearing pressure of the roller brush is decreased.

A fluid distribution means 17 is arranged on the upper side of the frame 10 in close connection to the roller brush, said distribution means comprising a number of jets 19 which are directed obliquely towards the cavity wall 18. The distribution means 17 is supplied by way of a hose 20 connected to a high pressure washing device (not shown), which can be arranged above the cavity or even outside the reactor building. The jets 19 of the distribution means 17 preferably make an angle of about 15° with the perpendicular (the horizontal plane) to the cavity wall 18.

On the upper side of the frame 10 there are arranged three hose reels 21, 22 and 23, the first reel 21 which carries the hose from the high pressure washing device to the distribution means 17, the second reel 22 of which carries a compressed air hose to the air-driven motor 14, while the third reel 23 carries the return air hose from the motor.

The cleaning machine is suspended in a three point yoke 24, the whole device being so balanced that the frame 10 hangs horizontally when the counterweight means is adjusted to provide a minimum effect.

The roller brush 12, as previously mentioned, is composed of a plurality of soft grinding sheaves comprising synthetic fibres orientated in a three-dimensional web structure, which is held together by a plastic binding agent. This three-dimensional web structure is homogeneously impregnated with abrasive particles, by which a very gentle but effective cleaning is achieved. It is very important that the contact surface of the roller brush 12 against the cavity wall 18 be correctly adapted to the diameter of the roller brush, said diameter being allowed to decrease through wear by about 3–4 cm from an external diameter of e.g. 20 cm.

In order to provide a correct contact surface against the cavity wall at a certain bearing pressure the cleaning machine is provided with a compressing means 25, which compresses the grinding sheaves axially along the shaft 11, which either can be made manually by tightening a nut at one or both end gables of the roller brush 12 or by means of e.g. a pneumatic servomotor, which compresses the discs or reduces the pressure against them.

In order to achieve a sufficiently rigid roller brush stiffening plates a are arranged at certain intervals between the grinding sheaves, said plates having a diameter somewhat smaller than the largest wearing depth. Such a plate is preferably arranged at every fith grinding sheave.

Figure 4:
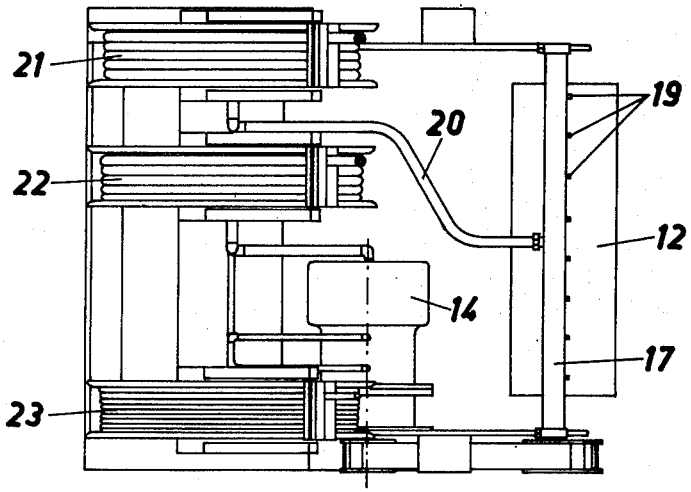
FIG. 4 shows the cleaning machine from above.
Figure 2:
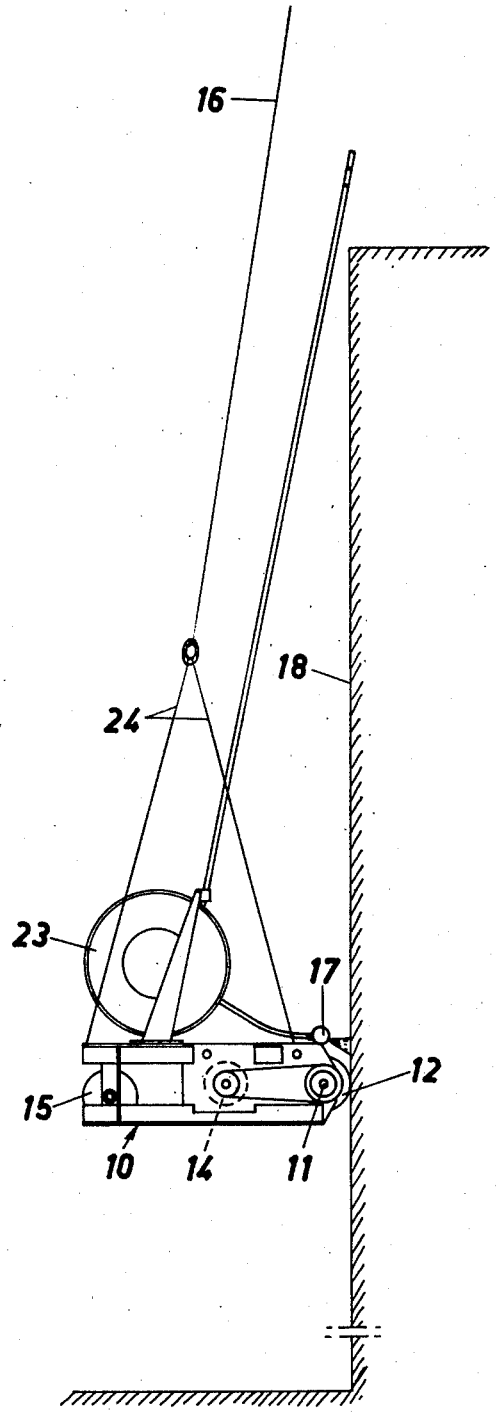
FIG. 2 shows the cleaning machine according to FIG. 1 while in a working position.
Figure 5:
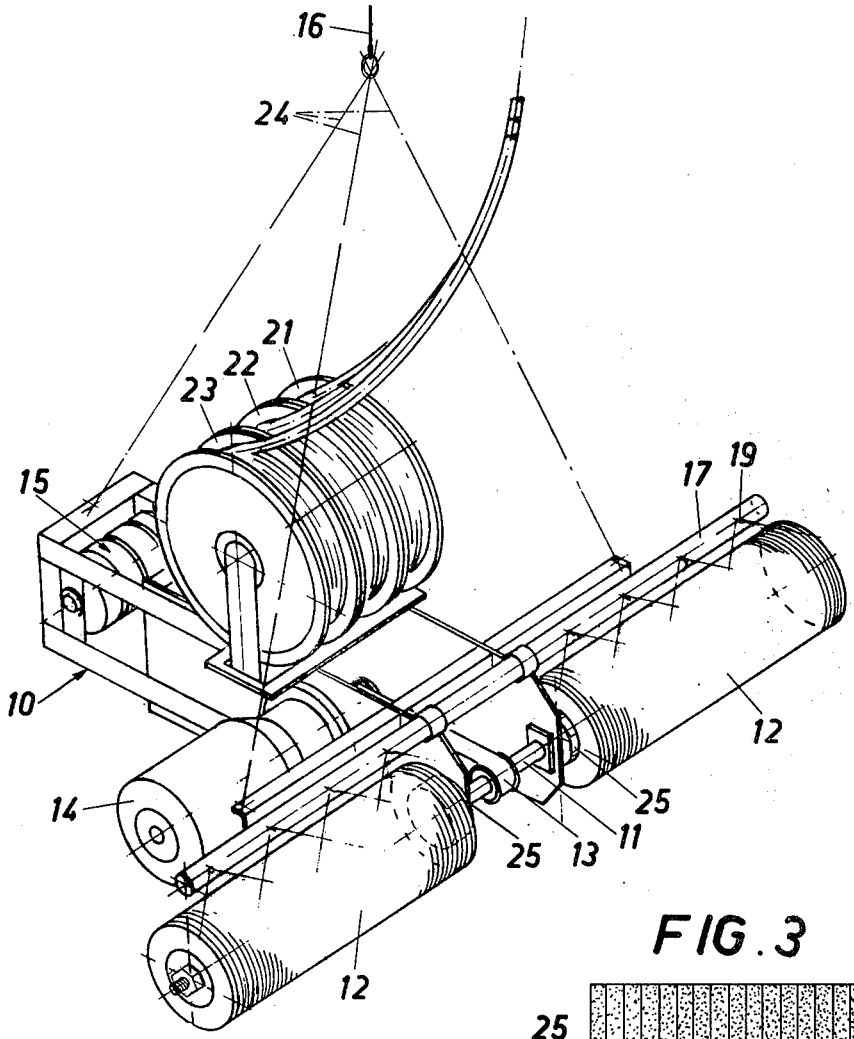
FIG. 5 is a perspective view of a modified embodiment of the cleaning machine.

The embodiment shown in FIG. 5 differs from the one shown in FIGS. 1, 2 and 4 by the fact that the roller brush 12 is divided into two parts arranged on each side of the transmission means 13, which is arranged on the central portion of the shaft 11. The shaft 11 is thus journalled in bearings only at its middle portion and the shaft ends are free, thus permitting a rapid exchange of roller brushes when they are worn down.

The compressing means 25 for the grinding sheaves can in this embodiment either be arranged centrally on the shaft 11 close to the bearing or it can be removeably arranged at the shaft ends and can comprise a servomotor controlled by signals from a pressure gauge measuring the pressure of the machine against the wall to be washed.

Figure 3:
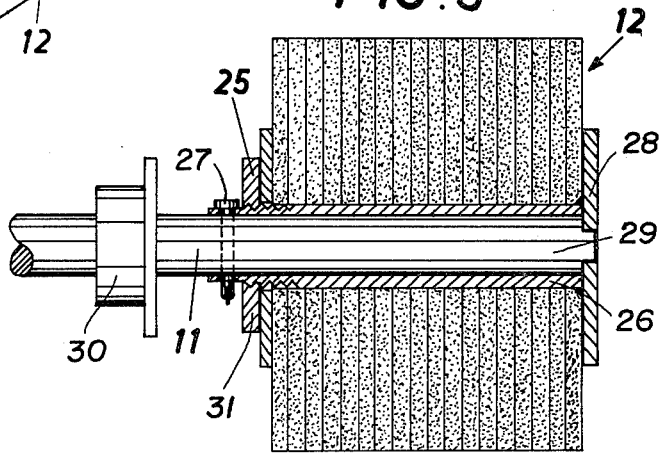
FIG. 3 is a section through an embodiment of a roller brush with a compressing means

In the embodiment according to FIG. 3 the grinding sheaves are attached to a sleeve 26, which is arranged on the shaft 11 and locked to this by means of a locking pin 27 or the like. A disc 28 is attached, e.g. welded, to one end of the sleeve 26 and forms a holder-on for the compressing means 25. The disc 28 has a central non-circular aperture for receiving a pin 29 projecting from the end of the shaft 11, said pin having a corresponding non-circular cross-section. The compressing means 25 comprises a nut arranged at the inner portion of the sleeve 26 facing the centrally arranged bearing 30. The sleeve 26 has a threaded portion along which the nut 25 can be screwed. A disc 31 attached to the nut 25 and displaceable on the sleeve 26 forms the contact surface of the compressing means against the grinding sheaves.

When exchanging a worn-down roller brush 12 the locking pin 27 is removed, at which the sleeve 26 can be removed from the shaft 11 and a new sleeve with a new roller brush be placed on the shaft. By adjusting the position of the nut 25 on the sleeve 26 the desired axial compression of the roller brush 12 is achieved.

The cleaning machine works in the following way. The washing operation is started at the upper edge of the cavity walls and is performed vertically downwards towards the cavity bottom. A rotary speed of about 200 rotations per minute has proved to be appropriate for the roller brushes, at the same time as the area above the roller brushes is sprayed with water with a pressure of about 110–130 $kg/cm_2$ from the high pressure washing device. For very deep cavities it may be necessary to adjust the bearing pressure on the way down to the cavity bottom, which can be made by increasing the counterweight and/or by compressing the roller brush so that the contact surface against the cavity wall is decreased.

The invention is not limited to the embodiments which have been shown and described in detail, but a plurality of modifications are possible within the scope of the claims. It is e.g. possible to exclude the high pressure washing device and instead having water running down the cavity walls from the upper edge thereof.

What I claim is:

1. A machine for cleaning vertical or inclined walls, especially reactor cavity walls in a nuclear power plant, comprising at least one roller brush supported by a frame, said frame being freely suspended by at least one wire from a lifting device and which frame, at the side remote from the roller brush, is provided with a counterweight means, said roller brush comprising a plurality of soft grinding sheaves attached to a shaft, said grinding sheaves being axially compressible by a compressing means in order to change the density of the roller brush and the contact surface against the wall to be cleaned, said counterweight means being provided with means for increasing or decreasing its weight and changing the position of the center of gravity of the machine and thus changing the bearing pressure against the wall.

2. A machine according to claim 1, wherein a fluid distribution means with jets directed towards said wall and connected to a washing fluid is arranged in connection to the roller brush.

3. A machine according to claim 2, wherein said fluid distribution means comprises jets directed obliquely towards said wall and being connected to a high pressure washing device.

4. A machine according to claim 1, wherein said compressing means comprises a servomotor controlled by signals from a pressure sensitive member measuring the pressure of the machine against the wall to be cleaned.

5. A machine according to claim 1, wherein the counterweight means comprises a container and that the counterweight is a liquid which can be filled into and drained off from said container.

6. A machine according to claim 1, wherein the roller brush shaft is freely mounted at one end or at its middle portion and that quick coupling means are arranged at the free shaft end/ends for nonrotatably attaching the roller brush on the shaft.

7. A machine according to claim 6, wherein the roller brush is arranged on a sleeve, which is nonrotatably and detachably arranged on the shaft and that said compressing means is axially displaceable along said sleeve.

8. A machine according to claim 7, wherein the compressing means comprises a nut threaded on said sleeve.

* * * * *